US009151145B2

(12) United States Patent
Scott

(10) Patent No.: US 9,151,145 B2
(45) Date of Patent: Oct. 6, 2015

(54) DOWNHOLE GAS RELEASE APPARATUS

(75) Inventor: Geoffrey Scott, Beaumont (CA)

(73) Assignee: GLOBAL OIL AND GAS SUPPLIES INC., Beaumont, Alberta (CA)

( * ) Notice: Subject to any disclaimer, the term of this patent is extended or adjusted under 35 U.S.C. 154(b) by 537 days.

(21) Appl. No.: 13/583,667

(22) PCT Filed: May 25, 2011

(86) PCT No.: PCT/CA2011/000626
§ 371 (c)(1),
(2), (4) Date: Oct. 12, 2012

(87) PCT Pub. No.: WO2011/147031
PCT Pub. Date: Dec. 1, 2011

(65) Prior Publication Data

US 2013/0025846 A1 Jan. 31, 2013

(30) Foreign Application Priority Data

May 25, 2010 (CA) ..... 2704401

(51) Int. Cl.
*E21B 43/12* (2006.01)

(52) U.S. Cl.
CPC ..... *E21B 43/127* (2013.01)

(58) Field of Classification Search
CPC E21B 2043/125; E21B 43/126; E21B 43/127
See application file for complete search history.

(56) References Cited

U.S. PATENT DOCUMENTS

| | | | | |
|---|---|---|---|---|
| 880,019 | A | 2/1908 | Futhey | |
| 2,344,786 | A | 3/1944 | Patterson | |
| 4,599,054 | A | 7/1986 | Spears | |
| 4,867,242 | A | 9/1989 | Hart | |
| RE33,163 | E | 2/1990 | Madden | |
| 5,655,604 | A * | 8/1997 | Newton | 166/369 |
| 5,893,708 | A | 4/1999 | Nelson, II | |
| 6,481,981 | B1 | 11/2002 | Burgdorf | |
| 6,481,987 | B2 | 11/2002 | Ford | |
| 2015/0098840 | A1 * | 4/2015 | Kowalchuk | 417/53 |

OTHER PUBLICATIONS

Dayzon Energy Solutions; Products; Internet; 2005; pp. 1-2.
Spears Specialty Oil Tools; Sidekicker Valve; Internet: www.spearsoiltools.com/sidekick; 2005; p. 1.

* cited by examiner

*Primary Examiner* — David Andrews
(74) *Attorney, Agent, or Firm* — Bennett Jones LLP

(57) ABSTRACT

The present invention provides for an apparatus for use with a traveling valve assembly of a downhole pump for releasing gas and thereby breaking gas locks. The apparatus comprises a piston slidably disposed within a cylindrical housing, the piston being driven by an attached plunger element. On the down stroke of the pump, the piston protrudes through end of the cylindrical housing engaging and opening the adjacent valve. On the up stroke of the pump, the piston retracts into the cylindrical housing, disengaging from the valve allowing it to close. Fluid flows along the outer surface of the apparatus by means of fluid ports connected by defined fluid passages.

16 Claims, 9 Drawing Sheets

DOWNHOLE GAS RELEASE APPARATUS

FIELD OF THE INVENTION

The present invention relates to an apparatus for use with a downhole oil and gas well pump and in particular to gas release apparatus for use with a reciprocating downhole pump having a traveling valve assembly.

BACKGROUND OF THE INVENTION

The production of oil and gas from wells drilled into the ground frequently requires the use of a mechanism to elevate fluid from the bottom of the borehole to the surface. A commonly employed mechanism comprises a reciprocating downhole pump driven by a motor, often a pump jack, at the surface. Such pumps typically have a stationary standing valve positioned at the bottom of a string of production tubing near the producing perforations of the well. A traveling plunger assembly in a hollow cylindrical barrel positioned above the standing valve has a traveling valve assembly that opens on the down stroke of the plunger and closes on the upstroke. In contrast, on the upstroke of the plunger the standing valve opens allowing fluid to fill the space below the plunger in the cylindrical barrel, and on the down stroke the standing valve closes trapping the fluid drawn into the cylindrical barrel during the upstroke of the plunger.

The plunger assembly is attached at its top end to a sucker rod which is actuated by the pump jack at the surface. In this manner, each upstroke lifts a column of fluid towards the surface while each down stroke charges the space immediately above the plunger with a new column of fluid ready for the next upstroke. There are numerous variations and configurations of this type of pump but in each instance, the consistent opening and closing of the traveling valve with the down and up strokes of the plunger is essential to the efficient pumping of oil up the production tubing.

The traveling valve assembly in such reciprocating pumps commonly consists of a ball and seat type valve comprising a ball resting on seat within a valve cage. On the down stroke, the movement of the valve assembly through the fluid and the incompressible nature of the liquid trapped between the traveling valve and the standing valve lifts the ball from its seat thereby opening the valve. On the up stroke, the hydrostatic pressure of the fluid and the movement of the valve assembly through the fluid forces the ball down onto the seat closing the valve. Other types of valves employing similar actuating mechanisms on the up and down strokes are employed, including flapper valves.

Although the reciprocating pump described above is reliable and commonly used, there are production circumstances that can render its use problematic and inefficient. In particular, wells that produce dissolved gases, such as natural gas, along with the oil and water can cause problems. Upon production, the dissolved gas can break out of the solution. Gas that is produced is easily drawn through the standing valve on the upstroke of the plunger. However, on the down stroke when the standing valve is closed and the liquid body below the traveling valve is normally expected to force the traveling valve open, gas between the traveling valve and the standing valve will compress and the greater force of the hydrostatic head of the fluid above the traveling valve will keep it closed. On the following upstroke, the compressed gas between the traveling valve and the standing valve expands to fill the enlarged space and this prevents the flow of more fluid through the standing valve into the cylindrical barrel. In this manner, the upstrokes and down strokes of the pump simply result in the repeated compression and expansion of trapped gas between the standing valve and the traveling valve and the pumping of fluid is prevented. This phenomenon is referred to as "gas locking".

An associated problem is "fluid pounding" which occurs when the space in the cylindrical barrel below the traveling valve is partially filled with fluid and partially with gas. The consequence of such a composition in the barrel cylinder is that the plunger forcefully enters the fluid level part way through the down-stroke. This causes undesired vibrations, or 'pounding', through the production string leading to mechanical failure and expedited wear.

There are prior art solutions to the problem of gas locking which usually involve some form of gas equalizer comprising a probe or piston that mechanically actuates the valve of the traveling valve assembly. This mechanical opening of the valve overcomes the hydrostatic pressure above the valve and allows any produced gas to flow through the traveling valve assembly thereby eliminating a gas seal from forming below the traveling valve. U.S. Pat. No. 4,867,242 to Hart and U.S. Pat. No. 5,382,142 to Spears are examples of prior art solutions to the problem of gas locking. Both have an actuated piston that engages and unseats the ball in the traveling valve assembly. However, in these prior art solutions, the produced fluid passes through a passage in the center of the apparatus. Whenever there is a narrowed passage or channel for the fluid to pass though that is smaller in diameter than the valve opening, or the internal diameter of the ball and seat in the case of a ball and seat type valve, there is a resulting pressure drop in the fluid which promotes the break out of scale and gas from the fluid. Scale build up over time causes the ports to become more restricted causing further pressure drop, loss of production and pump failure. Gas break out due to poor flow design can result in unwanted production problems such as fluid pounding.

Furthermore, the prior art gas breaking solutions are relatively complex and expensive to manufacture and implement. The replacement and maintenance of the prior art gas equalizers are also relatively time consuming and expensive. Furthermore, they are difficult to adapt for use with the many varieties and models of downhole pumps being employed in the field.

Therefore, what is required is an improved apparatus for use with a traveling valve assembly of a downhole pump for releasing gas to prevent gas locks. It would also be preferable if the apparatus mitigated the limitations of the prior art and had an improved flow design to mitigate the problem of pressure drop as the produced fluid moves through the traveling valve assembly.

SUMMARY OF THE INVENTION

The present invention is directed to an apparatus for use with a traveling valve assembly of a downhole pump for releasing gas and thereby breaking gas locks. Accordingly, in one aspect of the invention, the invention comprises a gas release apparatus for use with a reciprocating downhole pump having a traveling valve assembly having a valve, the pump having an up stroke and a down stroke, the apparatus comprising;

a. a substantially hollow cylindrical housing having an interior surface and an outer surface, the cylindrical housing having at least one fluid port extending from the interior surface to the outer surface of the cylindrical housing and the cylindrical housing being releasably attached to the traveling valve assembly;

b. a piston having first and second ends, slidably disposed within the cylindrical housing, the first end of the piston engaging the valve of the traveling valve assembly during the down stroke of the pump;

c. a plunger element attached to the second end of the piston, the plunger element having an outer surface, an inner passage and the plunger element having at least one fluid port extending from the inner passage to the outer surface; and d. the outer surfaces of the cylindrical housing and the plunger element both defining a fluid passage between the at least one fluid port of the housing and the at least one fluid port of the plunger, whereby fluid flows through the fluid passage between the ports substantially bypassing the piston.

In one embodiment, the valve comprises a ball and seat valve and the first end of the piston engages the ball and lifts the ball from the seat during down stroke of the pump. In a further embodiment, the valve comprises a flapper valve and the first end of the piston engages and opens the flapper valve during down stroke of the pump. In another embodiment, the plunger element has means to frictionally resist the reciprocating movement of the pump which may comprise at least one sealing ring disposed around the outer surface of the plunger element. In one embodiment, the cylindrical housing is attached at its first end to the traveling valve assembly by means of complementary male and female thread.

In one embodiment, the piston is movable between two positions comprising;

i. a first position that the piston assumes during at the bottom of the down stroke of the pump whereby the first end of the piston engages the valve of the traveling valve assembly; and ii. a second position that the piston assumes at the top of the up stroke of the pump whereby the first end of the first end of the piston is retracted into the cylindrical housing such that it does not engage the valve of the traveling valve assembly.

In one embodiment, the cylindrical housing defines three ports, the plunger element defines three ports and the outer surfaces of the cylindrical housing and the plunger element define three separate fluid passages, each such passage extending between a port on the cylindrical housing and a port on the plunger element.

In one aspect of the present invention, the invention comprises a gas release apparatus for use with a reciprocating downhole pump having a traveling valve assembly having a valve, the apparatus comprising:

a. a cylindrical housing having first and second ends, an outer surface, and a central passageway, the central passageway extending between the first and second ends, the first end being adapted to attach directly to traveling valve assembly of the pump, the cylindrical housing having at least fluid one port proximate to the first end extending from the central passageway to the outer surface of the cylindrical housing, the outer surface of the cylindrical housing defining a fluid passage extending from the fluid port to the second end of the cylindrical housing;

b. an elongate piston having a first end and a second end, the piston being slidably disposed in the central passageway of the cylindrical housing and the piston being movable between two positions comprising;

i. a first position that the piston assumes during the down stroke of the pump whereby the first end of the piston protrudes through the first end of the cylindrical housing and engages the valve of the traveling valve assembly; and ii. a second position that the piston assumes during the upstroke of the pump whereby the first end of the first end of the piston is retracted into the central passageway such that it does not engage the valve of the traveling valve assembly;

c. means for retaining the piston within the central passageway;

d. a cylindrical plunger element for driving the piston, the plunger element having a first end, a second end and an outer surface, the first end of the cylindrical plunger element being releasably attached to the second end of the piston, the cylindrical plunger element comprising;

i. means to frictionally resist the reciprocating movement of the pump;

ii. a central bore extending through the plunger element from its second end to a point proximate to the first end;

iii. at least one fluid port extending from the central bore to the outer surface of the cylindrical plunger, and iv. the outer surface of the cylindrical plunger element defining at least one fluid passage extending from the fluid port to the first end of the plunger element;

whereby when the piston moves into its first position the second end of the cylindrical housing and the first end of the plunger element abut each other and the at least one fluid passage in the plunger element and the at least one fluid passage on the outer surface of the cylindrical housing are aligned such that fluid may flow from the at least one fluid port in the plunger element to the at least one fluid port in the cylindrical housing.

In one embodiment, the valve is a ball and seat valve and the first end of the piston engages the ball and lifts the ball from the seat during down stroke of the pump. In another embodiment, the valve is a flapper valve and the first end of the piston engages and opens the flapper valve during down stroke of the pump. In another embodiment, the means to frictionally resist the reciprocating movement of the pump comprises at least one sealing ring disposed around the outer surface of the plunger element. In one embodiment, the means for retaining the piston within the central passageway comprises a bushing ring that is releasably attached to the second end of the cylindrical housing.

In one embodiment, the invention comprises a gas release apparatus for use with a reciprocating downhole pump having a traveling valve assembly having a valve, the apparatus consisting essentially of:

a. a cylindrical housing having first and second ends, an outer surface, and a central passageway, the central passageway extending between the first and second ends, the first end being adapted to attach directly to traveling valve assembly of the pump, the cylindrical housing having at least fluid one port proximate to the first end extending from the central passageway to the outer surface of the cylindrical housing, the outer surface of the cylindrical housing defining a fluid passage extending from the fluid port to the second end of the cylindrical housing;

b. an elongate piston having a first end and a second end, the piston being slidably disposed in the central passageway of the cylindrical housing and the piston being movable between two positions comprising;

i. a first position that the piston assumes during the down stroke of the pump whereby the first end of the piston protrudes through the first end of the cylindrical housing and engages the valve of the traveling valve assembly; and ii. a second position that the piston assumes during the upstroke of the pump whereby the first end of the first end of the piston is retracted into the central passageway such that it does not engage the valve of the traveling valve assembly;

c. means for retaining the piston within the central passageway;

d. a cylindrical plunger element for driving the piston, the plunger element having a first end, a second end and an outer surface, the first end of the cylindrical plunger element being releasably attached to the second end of the piston, the cylindrical plunger element comprising;

i. means to frictionally resist the reciprocating movement of the pump;

ii. a central bore extending through the plunger element from its second end to a point proximate to the first end;)

iii. at least one fluid port extending from the central bore to the outer surface of the cylindrical plunger, and iv. the outer surface of the cylindrical plunger element defining at least one fluid passage extending from the fluid port to the first end of the plunger element;

whereby when the piston moves into its first position the second end of the cylindrical housing and the first end of the plunger element abut each other and the at least one fluid passage in the plunger element and the at least one fluid passage on the outer surface of the cylindrical housing are aligned such that fluid may flow from the at least one fluid port in the plunger element to the at least one fluid port in the cylindrical housing.

In one embodiment, the depth, width and number of fluid passageways are configured such that the cross-sectional flow area of fluid around the outside of the apparatus is less restricted than the valve opening.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for an apparatus for use with a traveling valve assembly of a downhole pump for releasing gas and thereby breaking gas locks. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
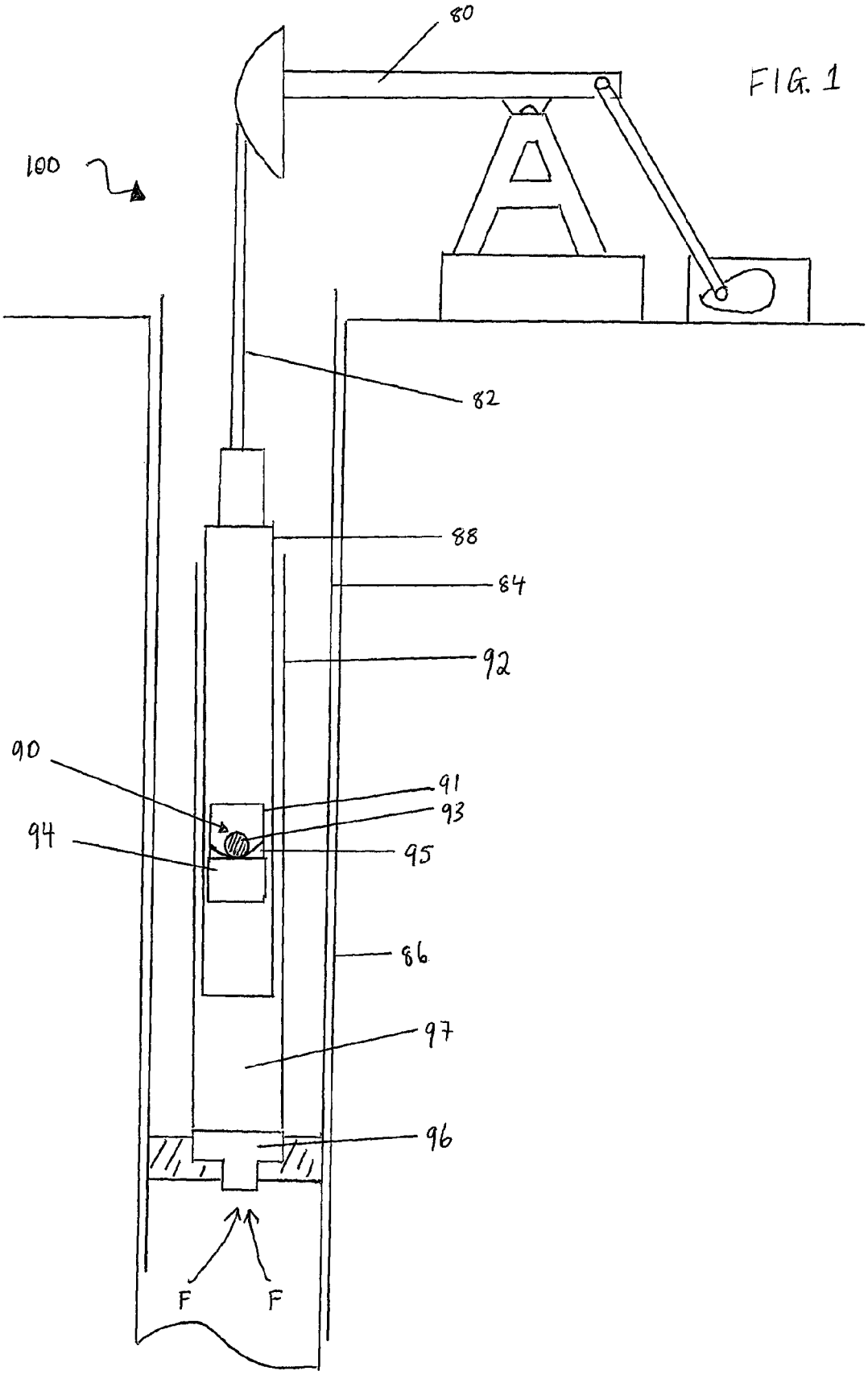
FIG. 1 is a diagrammatic depiction of one embodiment of a downhole pump assembly.

FIG. 1 depicts a typical reciprocating downhole pump (100). Production tubing (84) is positioned inside the casing (86) of a well bore. A reciprocating motor (80) is attached to a sucker rod (82). A cylinder barrel (92) is positioned above a standing valve (96) and a plunger (88) attached at its top end to the sucker rod (82) is reciprocated up and down the cylinder barrel (92) by the reciprocating motor (80). Inside the plunger (88) is a travelling valve assembly (94) having a valve (90), the valve having an opening (not shown) through which fluid flows. In one embodiment the valve (90) comprises a ball and seat valve comprising a ball (93) movably seated on a seat (95) and retained within a valve cage (91).

As the plunger (88) descends into the barrel cylinder (92) on the down stroke of the plunger (88), the ball (93) is lifted from its seat (95) and fluid passes from the space (97) between the travelling valve assembly (94) and the standing valve (96) and through the valve (90). The standing valve (96) is closed during the down stroke to trap the produced fluid in the cylinder barrel (92).

As the plunger (88) ascends on its upstroke, the ball (93) is forced back into its seat (95) by the hydrostatic pressure of the fluid above the valve (90) and the body of fluid above the plunger (88) is lifted. The standing valve (96) opens and fluid is drawn into the cylinder barrel (92) in flow (F) as depicted in FIGS. 1 and 2.

Figure 2:
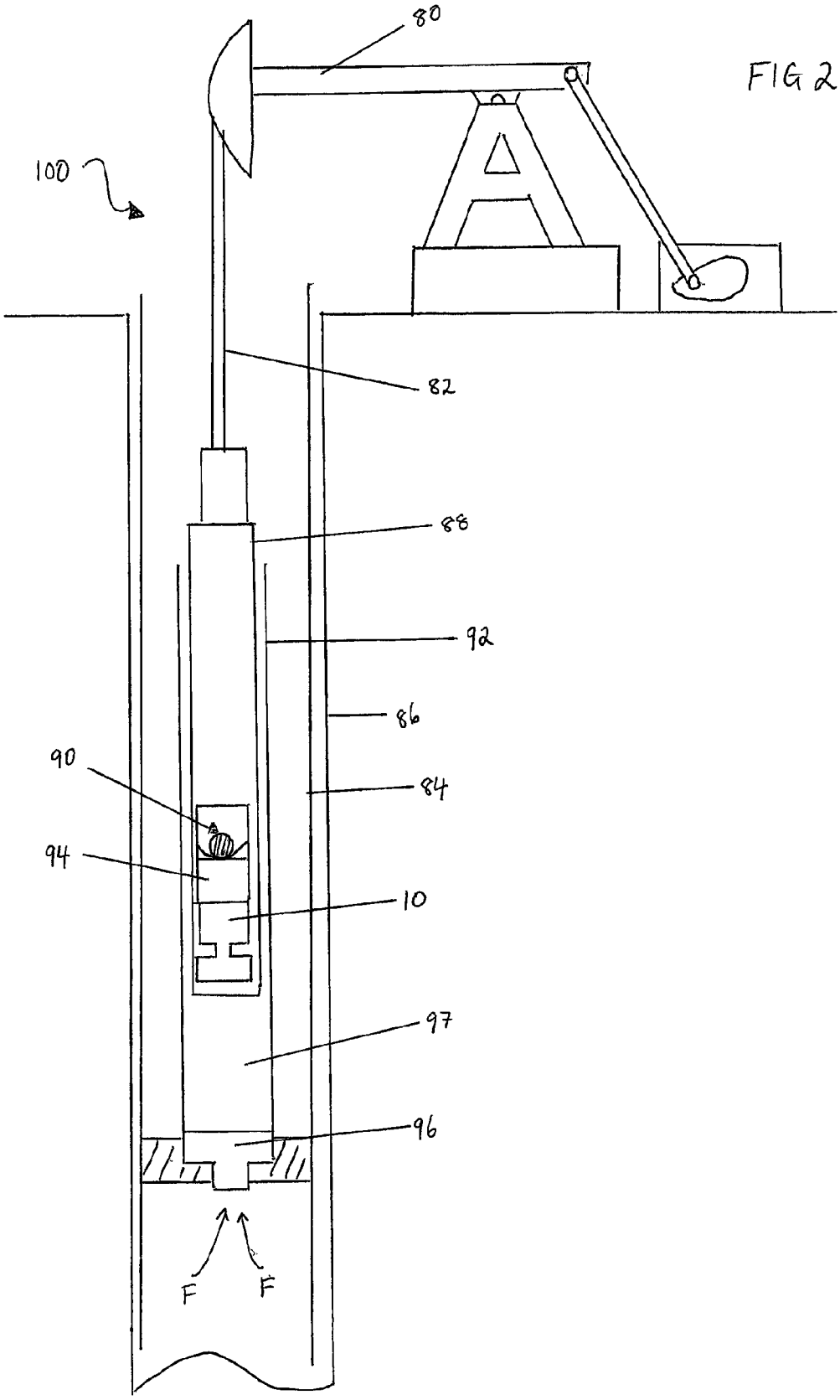
FIG. 2 is a diagrammatic depiction of the use of the present invention with a downhole pump assembly.

FIG. 2 shows the relative positioning of the apparatus of the present invention (10) in a conventional reciprocating downhole pump. FIGS. 1 and 2 are for illustrative purposes only and it will be understood by one skilled in the art that there are differing pump types, valve assemblies and downhole configurations with which the apparatus of the present invention (10) may be utilized.

Figure 6:
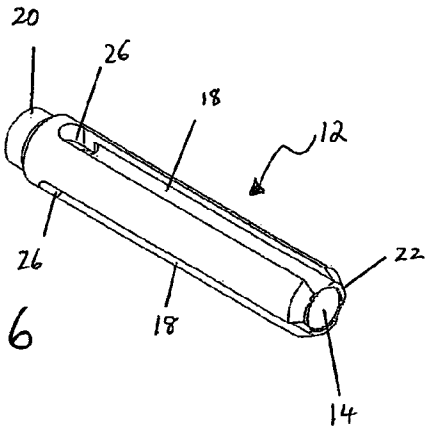
FIG. 6 is an elevated view of the housing cylinder.

The present invention is directed to an apparatus for use with a traveling valve assembly of a downhole pump for releasing gas. Having reference to the accompanying figures, the apparatus (10) comprises a substantially hollow cylindrical housing (12) having a first end (20) and a second end (22). The cylindrical housing (12) has an outer surface (16), an inner surface (24), defines a central passageway (14). The central passageway (14) extends from the first end (20) to the second end (22). The first end (20) of the cylindrical housing (12) is adapted to be attached directly to a traveling valve assembly and as shown in FIGS. 3 and 6, in one embodiment the first end (20) of the cylindrical housing (12) has a male thread configuration that mates with a complementary female thread on the valve cage of the traveling valve assembly.

Figure 5:
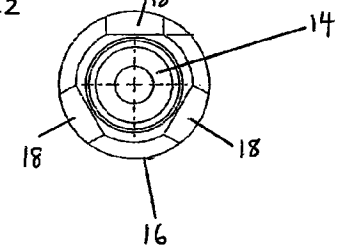
FIG. 5 is cross-section of the second end of the housing cylinder.

As shown in FIG. 2, in one embodiment the apparatus (10) of the present invention is mounted on the plunger (88) in a position immediately below the traveling valve assembly (94). The cylindrical housing (12) has at least one fluid port (26) proximate to the first end (20) extending out from the inner surface (24) of the passageway (14) to the outer surface (16) for fluid communication between the passageway (14) and the outer surface (16). The outer surface (16) of the cylindrical housing (12) defines a fluid passage (18) that extends along the outer surface (16) from the fluid port (26) to the second end (22). Having reference to the figures, it can be understood that there can be multiple ports and corresponding fluid passages configured in a similar manner, the fluid ports each entering the central passageway (14) at a common point. As shown in FIGS. 3, 4 and 5, in a one embodiment there are three ports (26) and three fluid passages (18) on the cylindrical housing (12).

Figure 3:
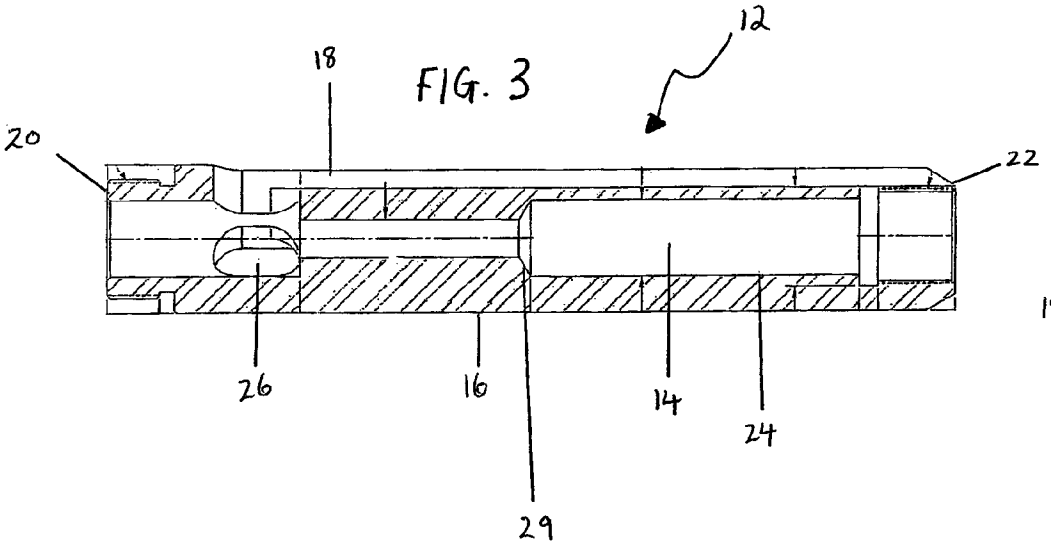
FIG. 3 is a is a lengthwise cross-section of the housing cylinder.
Figure 4:
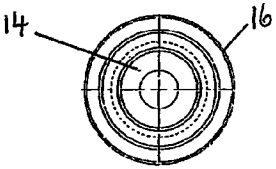
FIG. 4 is a cross-section of the first end of the housing cylinder.

As shown in FIG. 3, in one embodiment, the central passageway (14) of the cylindrical housing (12) has varying diameters along the length of the cylindrical housing (12). Proximate to the first end (20) the passageway (14) is bored such that the diameter is greater than the adjacent valve opening, or the internal diameter of the ball if a ball and seat valve is being employed. This widened section of the passageway (14) receives fluid from the fluid ports (26) holding it prior to entry into the adjacent valve (93).

As shown in FIG. 3, in one embodiment the central passageway (14) is narrowed in the middle to form a guide for the piston (30). Moving towards the second end of the cylindrical housing (12) the diameter of the central passage (14) flares forming a shoulder (29). As will be described in more detail later, this shoulder (29) engages the piston (30) on the down stroke of the plunger (88) restricting the amount of the protrusion of the first end (32) of the piston (30) out of the first end (20) of the cylindrical housing (12) and also confining the piston (30) within the cylindrical housing (12).

Figure 11:
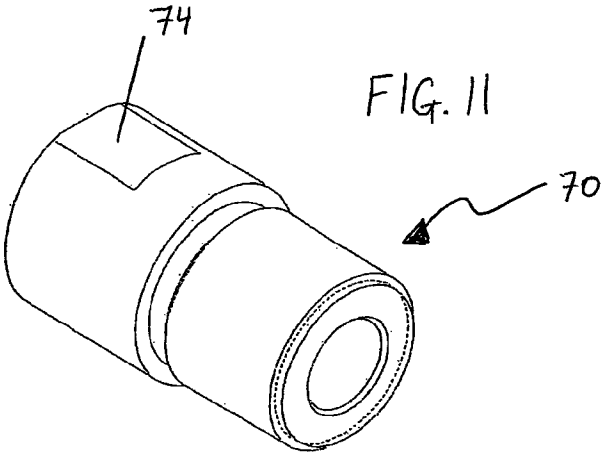
FIG. 11 is an elevated view of the bushing ring.

In one embodiment, the second end (22) of the cylindrical housing (12) is adapted to receive a bushing ring (70) that when installed acts to retain the piston (30) in the cylindrical housing (12) during the upstroke of the plunger (88) by means of engaging a lower shoulder (42) on the piston (30). The bushing ring (30) may have a threaded into the second end (22) of the cylindrical housing (12). As shown in FIG. 11, the bushing ring may also have wrench flats (74) defined on its outer surface to aid with installation and removal. Although the Figures depict a bushing ring (70) it may be understood that any other suitable means of retaining the piston (30) within the cylindrical housing (12) may be employed at the second end (22) of the cylindrical housing (12).

Figure 7:
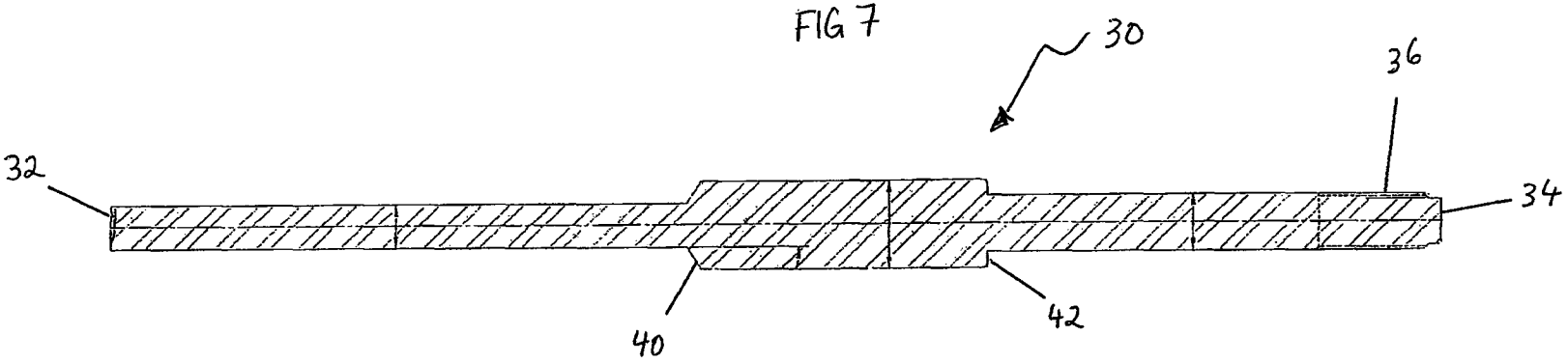
FIG. 7 is a lengthwise cross-sectional view of the piston.
Figure 8:
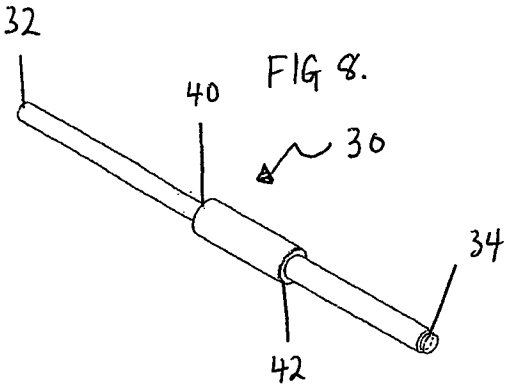
FIG. 8 is an elevated view of the piston.
Figure 9:
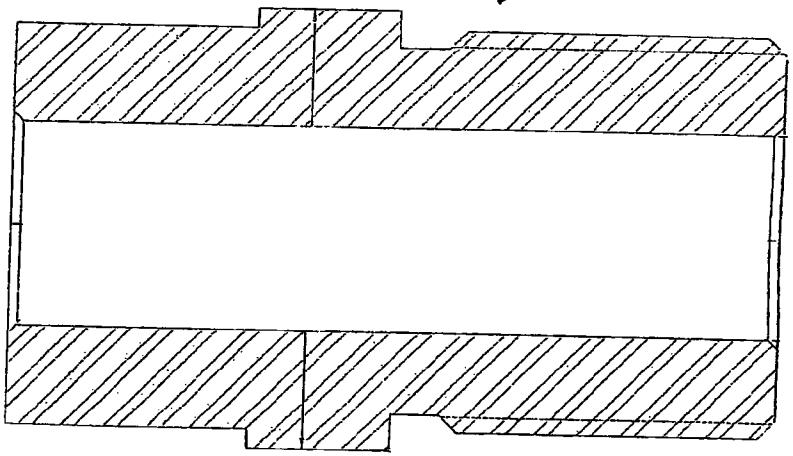
FIG. 9 is a lengthwise cross-sectional view of the bushing ring.
Figure 10:
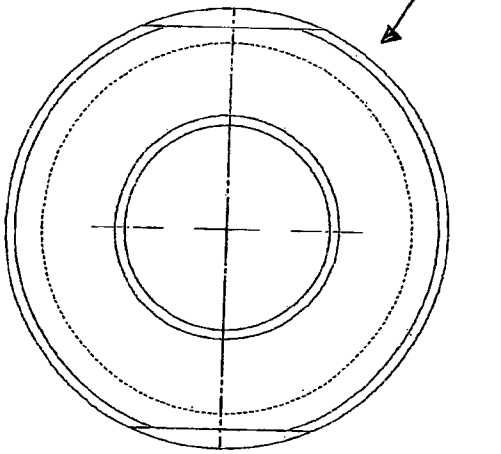
FIG. 10 is an endwise cross-sectional view of the bushing ring.

The elongate piston (30) is shown in FIGS. 7 and 8 and it has a first end (32) and a second end (34). The first end (32) is adapted to engage the valve (93) of the valve assembly (94) on the down stroke of the plunger (88). If a ball and seat valve is being employed, then the first end (32) of the piston (30) may have concave configuration (not shown in the figures) to facilitate enhanced contact with the ball. The elongate piston (30) has a widened portion in its central portion forming an upper shoulder (40) and a lower shoulder (42) that engage a shoulder (29) in the central passageway (14) of the cylindrical housing and the bushing ring (70) respectively as previously described.

Figure 12:
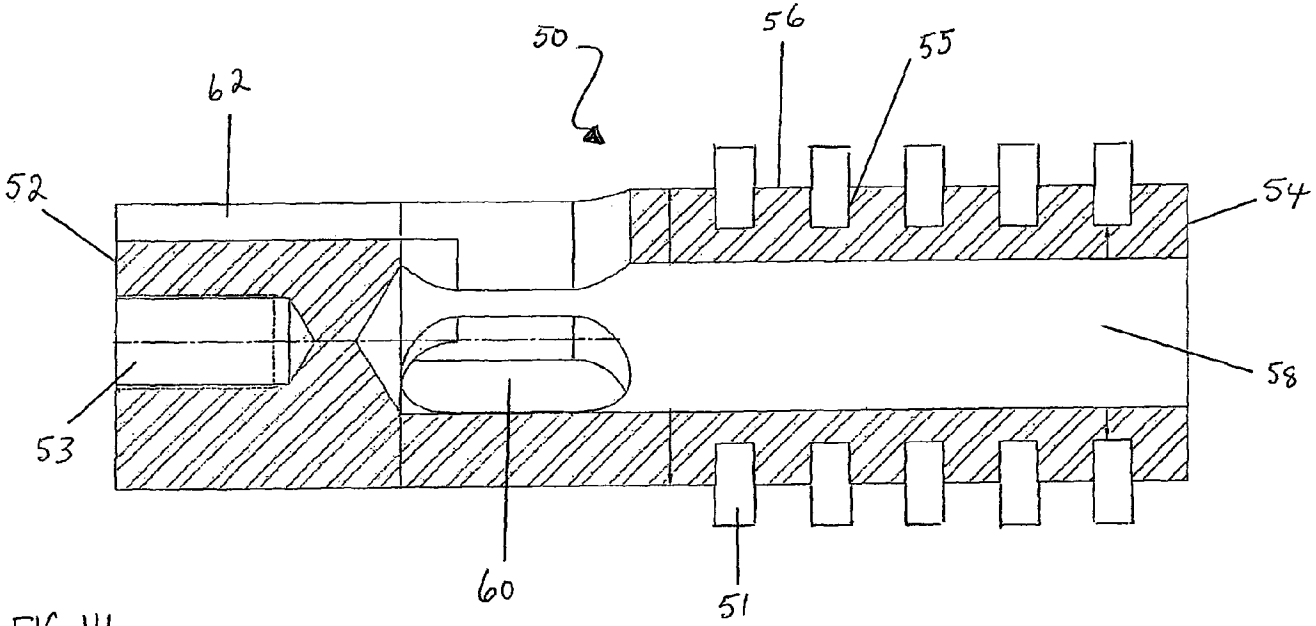
FIG. 12 is a lengthwise cross-sectional view of the first end of the plunger element.
Figure 13:
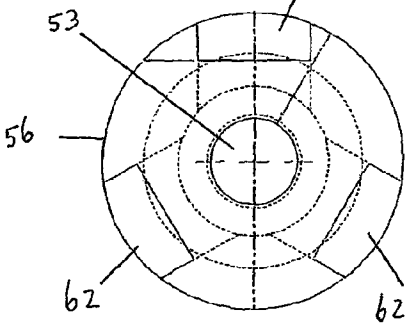
FIG. 13 is a cross-sectional view of the plunger element.
Figure 14:
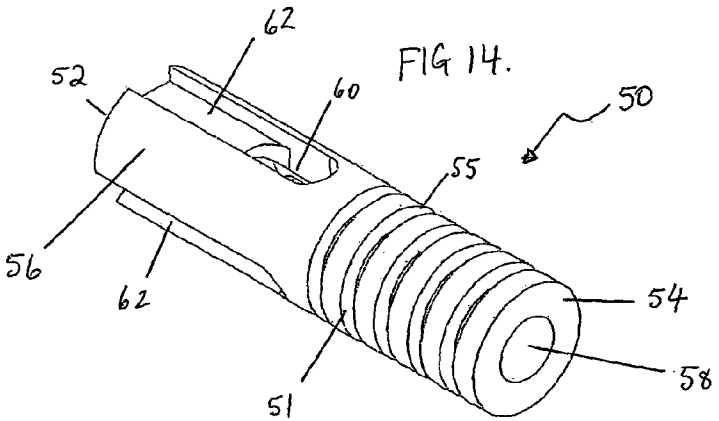
FIG. 14 is an elevated view of the plunger element.

The second end (34) of the piston (30) is releasably attached to a cylindrical plunger element (50) having a first end (52) and a second end (54) and an outer surface (56). Any suitable attachment means may be used however, as shown in the Figures, in one embodiment the second end (34) of the piston (30) threads into (36, 53) the first end (52) of the plunger element (50). As shown in FIGS. 12, 13 and 14, the plunger element (50) has a central bore (58) extending from its second end (54) to position proximate to its first end (52). As also shown in FIGS. 12, 13 and 14, the plunger element (50) has at least one fluid port (60) extending from the central bore (58) to its outer surface (56) for fluid communication between the central bore (58) and the outer surface (56). The outer surface (56) of the plunger element (50) defines a fluid passage (62) that extends from the fluid port (60) to the first end (52) of the plunger element (50). The plunger element (50) may have a plurality of ports and fluid passages and as shown in FIGS. 13 and 14, and in a preferred embodiment, three ports (60) and three fluid passages (62) are utilized.

The plunger element (50) also has means to resist the reciprocating movement of the plunger (88) which provides a forceful drive for the piston (30). Any suitable resistive means may be employed but as shown in the Figures, in one embodiment a plurality of sealing rings (51) are used that are seated in grooves (55) around the circumference of the plunger element (50). The sealing rings (51) engage the walls of the barrel cylinder (92) providing frictional resistive force and also exert a hydrostatic force on the surrounding fluid as they are moved through the fluid. This promotes rapid and forceful movement of the piston (30) as the plunger (88) reciprocates on its up and down strokes within the cylindrical barrel (92). The sealing rings (51) also act to wipe the sides of the barrel cylinder (92) which aids in the lifting of fluid and in minimizing the build of debris such as sand in the barrel cylinder (92). The sealing rings (51) may be manufactured from any suitable material, such as an elastomer or a rubber, and can be easily interchanged in the event of wear or incompatibility with the fluid being produced in the well.

Figure 17:
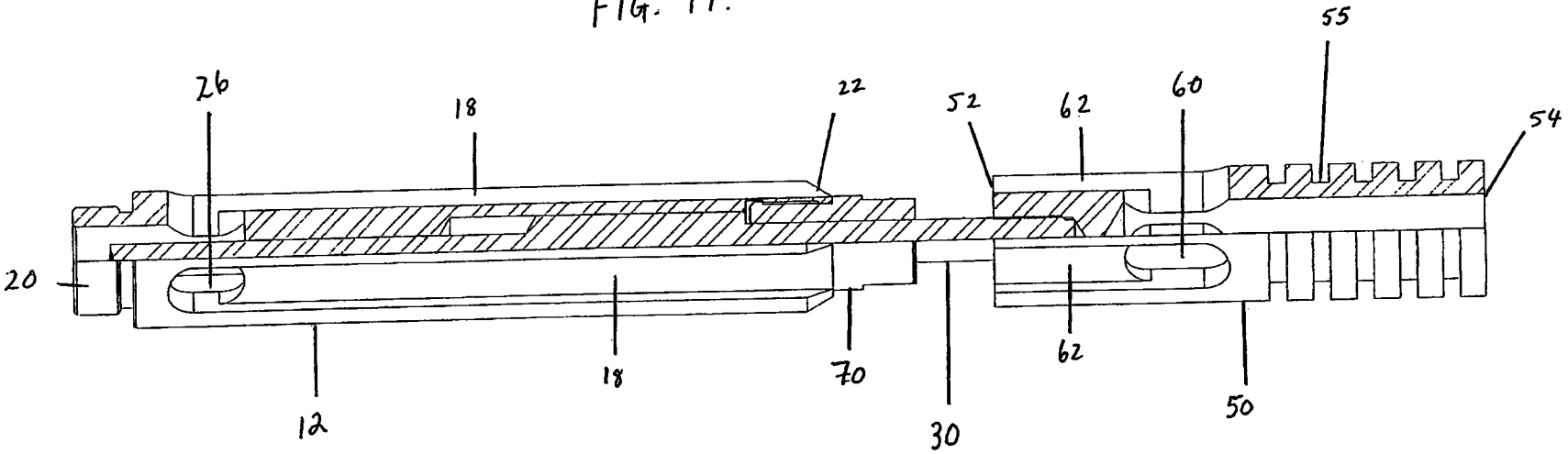
FIG. 17 is a cross-sectional side view of the assembled apparatus.

FIG. 17 depicts the assembled apparatus and shows the relationship of the cylindrical housing (12), the ring bushing (70), the piston (30) and the plunger element (50).

Figure 15:
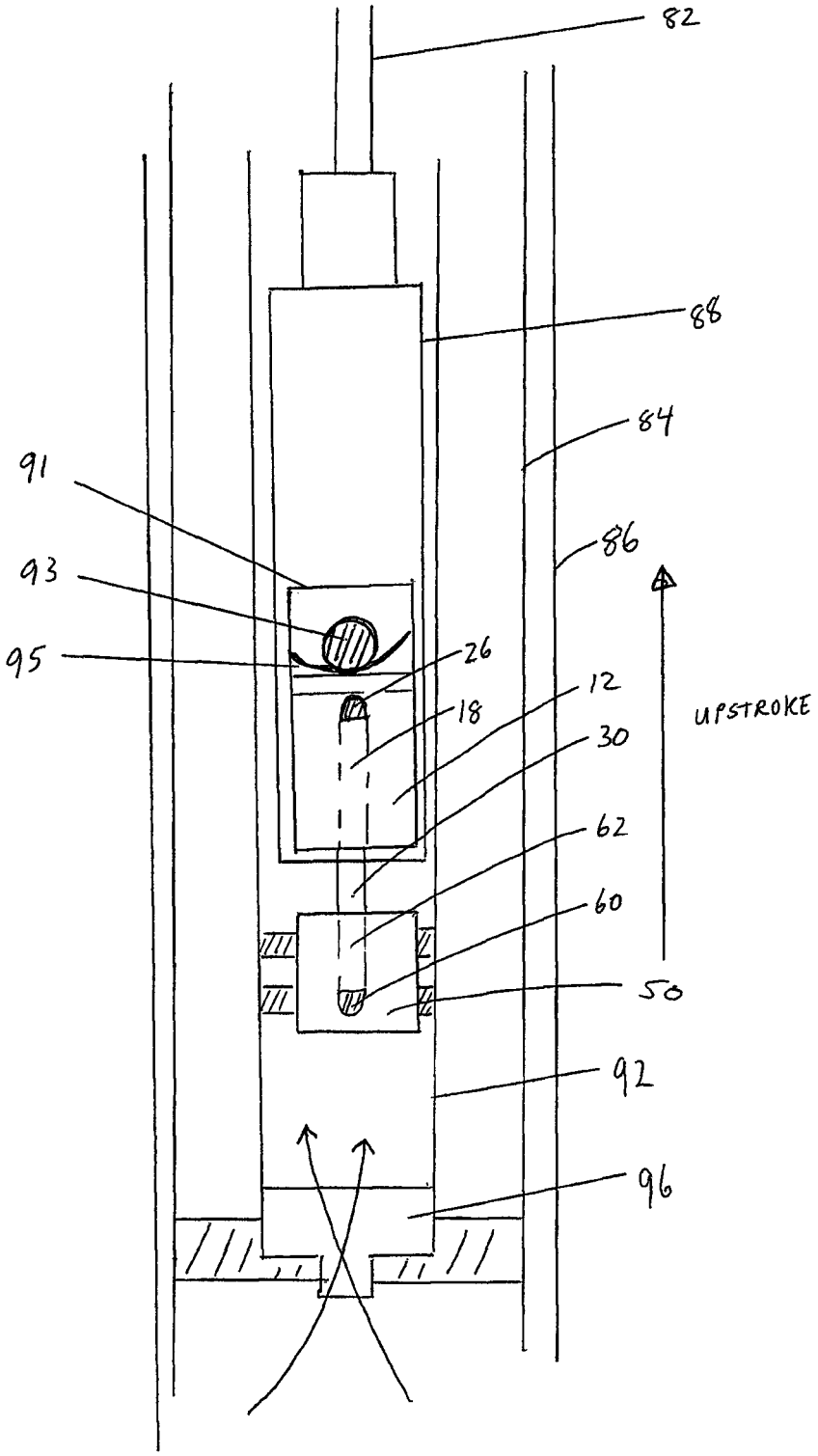
FIG. 15 is a cross-sectional view of the assembled invention and cooperating environment on the up-stroke.
Figure 16:
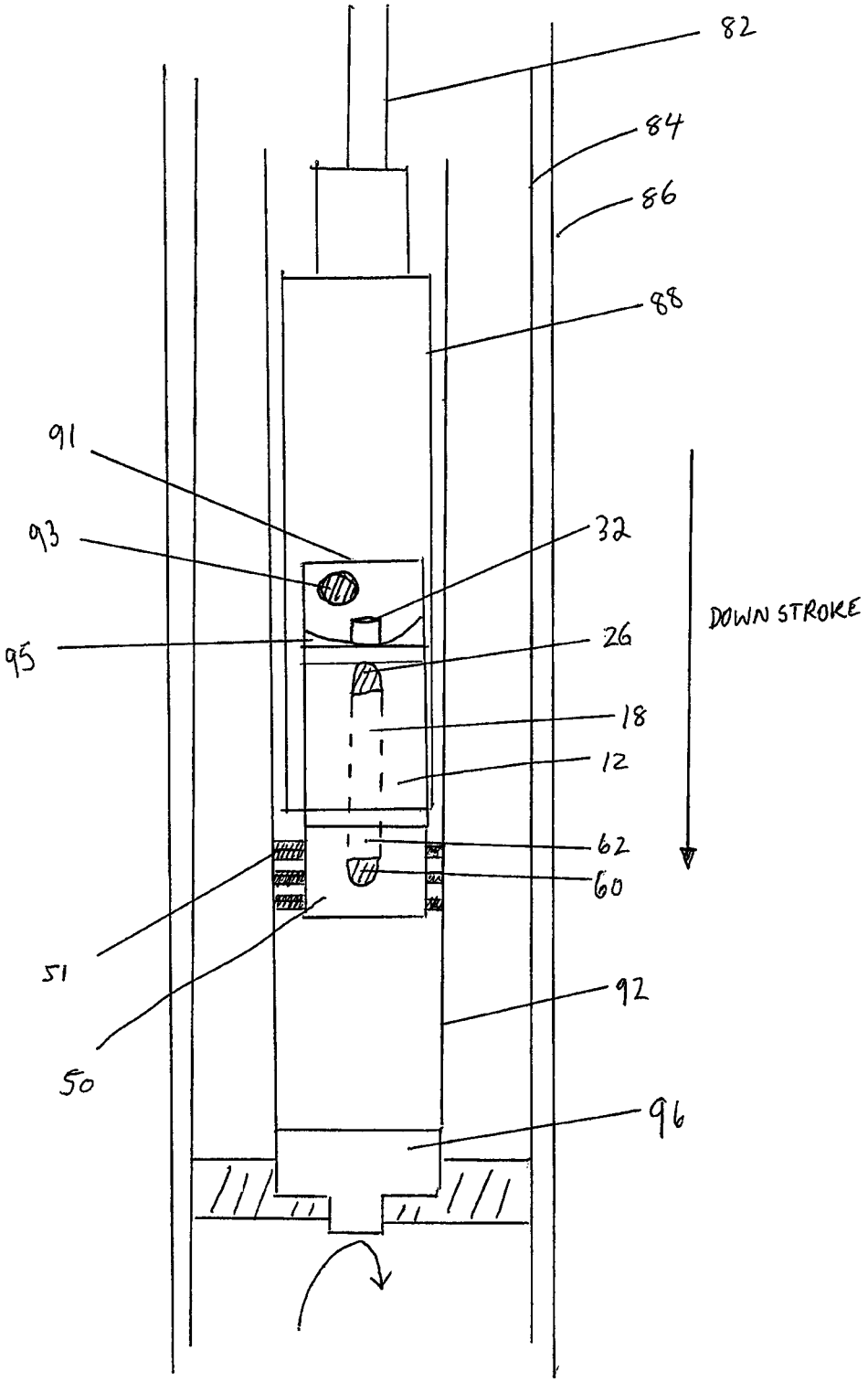
FIG. 16 is a cross sectional view of the assembled invention and cooperating environment on the down-stroke.

Having regard to the FIGS. 15 and 16, and the foregoing description, the operation of the apparatus will now be described. A shown in FIG. 15, on the down stroke of the plunger (88), the traveling valve (94) descends into the cylindrical barrel (92) towards the standing valve (96). The standing valve (96) closes. The resistive force exerted by the plunger element (50) drives the piston (30) upwards to move into a first position whereby the upper shoulder (40) of the piston (30) engages the shoulder (29) in the central passageway (14) of the cylindrical housing (12). In this position, the first end (52) of the plunger element (50) and the second end (22) of the cylindrical housing (12) abut. The fluid passages (18, 62) align forming continuous fluid passages between the fluid ports (26) in the cylindrical housing (12) and the fluid ports (60) in the plunger element (50). Fluid and gas in the cylinder barrel (92) between the standing valve (96) and the traveling valve assembly (94) move into the central bore (58) of the plunger element (50) and then flow into the fluid ports (60) in the plunger element (50). The fluid and gas moves from the fluid ports (60) in the plunger element (50) up the fluid passage (62, 18) defined by the outer surfaces of the plunger element (50) and the cylindrical housing (12), and into the fluid ports (26) in the cylindrical housing (12). The fluid and gas enters the central passage way (14) adjacent to the first end (20) of the cylindrical housing (12) and then flows to the valve above (93). The first end (32) of the piston (30) protrudes through the first end (20) of the cylindrical housing (12) and into the adjacent valve assembly (94). In the case of a ball and seat valve, the first end of the piston (32) engages the ball (93) and lifts it from its seat (95), opening the valve (90). In the case of a flapper valve (not shown), the first end (32) of the piston (30) engages and lifts the flapper.

The gas and fluid can flow through the open valve into the space above the valve assembly (94). Thus, with each down stroke of the plunger (88), the valve (90) is mechanically opened to ensure the constant flow of fluid and gas through the traveling valve assembly (94). It can be understood that in this manner, fluid flows from the bottom of the gas release apparatus (10) to the valve (90) not through a central passage, but rather around the outside of the apparatus by means of the ports and defined fluid passageways. The fluid effectively bypasses the piston (30) housed in the cylindrical housing (12). Furthermore, in one embodiment, the depth, width and number of the fluid passageways are configured such that the combined cross-sectional flow area of fluid around the outside of the apparatus (10) is less restricted than the valve opening itself. This flow design has reduced flow restrictions in comparison to a central passageway and mitigates the problem of pressure drop in the produced fluid.

On the upstroke of the plunger (88), the resistive force of the plunger element (50) acts to pull the piston (3) down into its second position whereby the lower shoulder (42) of the piston (30) engages the bushing ring (70). The first end (32) of the piston (30) disengages from the valve (90) and retracts into the central passageway (14) of the cylindrical housing (12). In the case of a ball and seat valve, the ball is forced back onto the seat and in the case of a flapper valve, the flapper is shut closing the valve in both instances. The plunger (88) is then able to lift the body of fluid immediately above the valve assembly (94). The standing valve (96) opens and fluid and gas is drawn into the barrel cylinder (92) ready for the next down stroke of the plunger (88). This process is repeated such that fluid is continually lifted to the surface.

In one embodiment, the apparatus is manufactured from stainless steel to minimize corrosion and wear. However, it can be understood that any suitable materials as would be) utilized by one skilled in the art may be used to construct the apparatus.

The present apparatus may be constructed in varying sizes for use with differing downhole environments, casing sizes and types of traveling valve assemblies. Typical sizes include without limit, two inch diameter and one and a half inch diameter. It can be understood that the apparatus can be constructed to meet the size requirements of any particular end user.

In addition to improved fluid flow, other advantages of the present invention include the relative ease with which it can be assembled and disassembled because of the threaded connections. The present invention also has relatively few parts compared to prior art solutions making it more efficient and simpler to use. Worn parts, such as the sealing rings can be quickly isolated and easily interchanged with replacement parts. When used with a ball and seat valve,) the present invention also allows free movement of the ball within the valve cage. As a result, the first end (32) of the piston (30) will not be restricted to contacting the ball (93) at the same point each time thereby reducing wear.

As will be apparent to those skilled in the art, various modifications, adaptations and variations of the foregoing specific disclosure can be made without departing from the scope of the invention claimed herein.

What is claimed is:

1. A gas release apparatus for use with a reciprocating downhole pump having a traveling valve assembly having a valve, the pump having an up stroke and a down stroke, the apparatus comprising;

a. a substantially hollow cylindrical housing having an interior surface and an outer surface, the cylindrical housing having at least one fluid port extending from the interior surface to the outer surface of the cylindrical housing and the cylindrical housing being releasably attached to the traveling valve assembly;

b. a piston having first and second ends slidably disposed within the cylindrical housing, the first end of the piston engaging the valve of the traveling valve assembly during the down stroke of the pump;

c. a plunger element attached to the second end of the piston, the plunger element having an outer surface, an inner passage and the plunger element having at least one fluid port extending from the inner passage to the outer surface; and d. the outer surfaces of the cylindrical housing and the plunger element both defining a fluid passage between the at least one fluid port of the cylindrical housing and the at least one port of the plunger whereby fluid flows through the fluid passage between the ports substantially bypassing the piston.

2. The apparatus of claim 1 wherein the valve comprises a ball and seat valve and the first end of the piston engages the ball and lifts the ball from the seat during down stroke of the pump.

3. The apparatus of claim 1 wherein the valve comprises a flapper valve and the first end of the piston engages and opens the flapper valve during down stroke of the pump.

4. The apparatus of claim 1 wherein the plunger element further comprises means to frictionally resist the reciprocating movement of the pump.

5. The apparatus of claim 4 wherein the means to frictionally resist the reciprocating movement of the pump comprises at least one sealing ring disposed around the outer surface of the plunger element.

6. The apparatus of claim 1 wherein the cylindrical housing is attached at its first end to the traveling valve assembly by means of complementary male and female thread.

7. The apparatus of claim 1 wherein the piston is movable between two positions comprising;

i. a first position that the piston assumes at the bottom of the down stroke of the pump whereby the first end of the piston engages the valve of the traveling valve assembly; and ii. a second position that the piston assumes at the top of the up stroke of the pump whereby the first end of the first end of the piston is retracted into the cylindrical housing such that it does not engage the valve of the traveling valve assembly.

8. The apparatus of claim 1 wherein the cylindrical housing defines three ports, the plunger element defines three ports and the outer surfaces of the cylindrical housing and the plunger element define three separate fluid passages, each such passage extending between a port on the cylindrical housing and a port on the plunger element.

9. The apparatus of claim 1 wherein the depth, width and number of fluid passageways are configured such that the cross-sectional flow area of fluid around the outside of the apparatus is less restricted than the valve opening.

10. A gas release apparatus for use with a reciprocating downhole pump having a traveling valve assembly having a valve, the apparatus comprising:

a. a cylindrical housing having first and second ends, an outer surface, and a central passageway, the central passageway extending between the first and second ends, the first end being adapted to attach directly to traveling valve assembly of the pump, the cylindrical housing having at least fluid one port proximate to the first end extending from the central passageway to the outer surface of the cylindrical housing, the outer surface of the cylindrical housing defining a fluid passage extending from the fluid port to the second end of the cylindrical housing;

b. an elongate piston having a first end and a second end, the piston being slidably disposed in the central passageway of the cylindrical housing and the piston being movable between two positions comprising;
   i. a first position that the piston assumes during the down stroke of the pump whereby the first end of the piston protrudes through the first end of the cylindrical housing and engages the valve of the traveling valve assembly; and
   ii. a second position that the piston assumes during the upstroke of the pump whereby the first end of the first end of the piston is retracted into the central passageway such that it does not engage the valve of the traveling valve assembly;

c. means for retaining the piston within the central passageway;

d. a cylindrical plunger element for driving the piston, the plunger element having a first end, a second end and an outer surface, the first end of the cylindrical plunger element being releasably attached to the second end of the piston, the cylindrical plunger element comprising;
   i. means to frictionally resist the reciprocating movement of the pump;
   ii. a central bore extending through the plunger element from its second end to a point proximate to the first end;
   iii. at least one fluid port extending from the central bore to the outer surface of the cylindrical plunger, and
   iv. the outer surface of the cylindrical plunger element defining at least one fluid passage extending from the fluid port to the first end of the plunger element;

whereby when the piston moves into its first position the second end of the cylindrical housing and the first end of the plunger element abut each other and the at least one fluid passage in the plunger element and the at least one fluid passage on the outer surface of the cylindrical housing are aligned such that fluid may flow from the at least one fluid port in the plunger element to the at least one fluid port in the cylindrical housing.

11. The apparatus of claim 10 wherein the valve is a ball and seat valve and the first end of the piston engages the ball and lifts the ball from the seat during down stroke of the pump.

12. The apparatus of claim 10 wherein the valve is a flapper valve and the first end of the piston engages and opens the flapper valve during down stroke of the pump.

13. The apparatus of claim 10 wherein the means to frictionally resist the reciprocating movement of the pump comprises a plurality of sealing rings disposed around the outer surface of the plunger element.

14. The apparatus of claim 10 wherein the means for retaining the piston within the central passageway comprises a bushing ring that is releasably attached to the second end of the cylindrical housing.

15. The apparatus of claim 10 wherein the depth, width and number of fluid passageways are configured such that the cross-sectional flow area of fluid around the outside of the apparatus is less restricted than the valve opening.

16. A gas release apparatus for use with a reciprocating downhole pump having a traveling valve assembly having a valve, the apparatus consisting essentially of:

a. a cylindrical housing having first and second ends, an outer surface, and a central passageway, the central passageway extending between the first and second ends, the first end being adapted to attach directly to traveling valve assembly of the pump, the cylindrical housing having at least fluid one port proximate to the first end extending from the central passageway to the outer surface of the cylindrical housing, the outer surface of the cylindrical housing defining a fluid passage extending from the fluid port to the second end of the cylindrical housing;

b. an elongate piston having a first end and a second end, the piston being slidably disposed in the central passageway of the cylindrical housing and the piston being movable between two positions comprising;
   i. a first position that the piston assumes during the down stroke of the pump whereby the first end of the piston protrudes through the first end of the cylindrical housing and engages the valve of the traveling valve assembly; and
   ii. a second position that the piston assumes during the upstroke of the pump whereby the first end of the first end of the piston is retracted into the central passageway such that it does not engage the valve of the traveling valve assembly;

c. means for retaining the piston within the central passageway;

d. a cylindrical plunger element for driving the piston, the plunger element having a first end, a second end and an outer surface, the first end of the cylindrical plunger element being releasably attached to the second end of the piston, the cylindrical plunger element comprising;
   i. means to frictionally resist the reciprocating movement of the pump;
   ii. a central bore extending through the plunger element from its second end to a point proximate to the first end;
   iii. at least one fluid port extending from the central bore to the outer surface of the cylindrical plunger, and
   iv. the outer surface of the cylindrical plunger element defining at least one fluid passage extending from the fluid port to the first end of the plunger element;

whereby when the piston moves into its first position the second end of the cylindrical housing and the first end of the plunger element abut each other and the at least one fluid passage in the plunger element and the at least one fluid passage on the outer surface of the cylindrical housing are aligned such that fluid may flow from the at least one fluid port in the plunger element to the at least one fluid port in the cylindrical housing.

* * * * *